US007025562B2

(12) United States Patent
Imbourg et al.

(10) Patent No.: US 7,025,562 B2
(45) Date of Patent: Apr. 11, 2006

(54) DEVICE FOR COOLING TURBINE DISKS

(75) Inventors: Sébastien Imbourg, Yerres (FR); Jean-Luc Soupizon, Vaux le Penil (FR); Philippe Pabion, Vaux le Penil (FR)

(73) Assignee: SNECMA Moteurs, Paris (FR)

( * ) Notice: Subject to any disclaimer, the term of this patent is extended or adjusted under 35 U.S.C. 154(b) by 78 days.

(21) Appl. No.: 10/777,663

(22) Filed: Feb. 13, 2004

(65) Prior Publication Data

US 2004/0161334 A1 Aug. 19, 2004

(30) Foreign Application Priority Data

Feb. 14, 2003 (FR) ..... 03 01842

(51) Int. Cl.
*F01D 5/14* (2006.01)

(52) U.S. Cl. ..... 415/115; 415/191; 415/209.2

(58) Field of Classification Search ..... 415/191, 415/209.2, 115
See application file for complete search history.

(56) References Cited

U.S. PATENT DOCUMENTS 2,912,221 A 11/1959 Chamberlin
3,945,758 A * 3/1976 Lee ..... 415/144
4,217,755 A 8/1980 Williams
4,805,398 A 2/1989 Jourdain et al.
5,358,374 A * 10/1994 Correia et al. ..... 415/47
5,503,528 A 4/1996 Glezer et al.
6,065,928 A * 5/2000 Rieck et al. ..... 415/115
6,152,685 A * 11/2000 Hagi ..... 415/14
6,179,555 B1 1/2001 Tremaine
6,464,232 B1 * 10/2002 Marchi et al. ..... 277/630
6,551,056 B1 * 4/2003 Rau ..... 415/115

FOREIGN PATENT DOCUMENTS

FR 1.351.268 1/1964

* cited by examiner

*Primary Examiner*—Edward K. Look
*Assistant Examiner*—Devin Hanan
(74) *Attorney, Agent, or Firm*—Oblon, Spivak, McClelland, Maier & Neustadt, P.C.

(57) ABSTRACT

A turbine disk cooling device fed with cooling air from an orifice through an annular support platform for a fixed vane of a low-pressure turbine is disposed between an upstream flange and a downstream flange of the support platform. The device includes upstream and downstream annular plates longitudinally defining an annular cavity, a sealing device extending longitudinally between the upstream and downstream plates so as to close the cooling air cavity, an element to hold the upstream and downstream plates against upstream and downstream flanges of the support platform, and a plurality of holes for ejecting cooling air towards the turbine disks.

20 Claims, 4 Drawing Sheets

DEVICE FOR COOLING TURBINE DISKS

BACKGROUND OF THE INVENTION

The present invention relates to the general field of cooling the disks of high-pressure and low-pressure turbines in a turbomachine. The invention relates more particularly to a device for cooling the disk of moving blades of the high-pressure turbine and the disks of rotary blades of the low-pressure turbine in a turbomachine.

In a turbomachine, the disks of the high- and low-pressure turbines are generally cooled by injecting air coming from the nozzle of the low-pressure turbine via annular plates mounted under the bottom platform supporting fixed vanes of the nozzle. FIG. 7 is a diagram of the junction between the high- and low-pressure turbines of a turbomachine with a cooling device of known type. In this figure, three annular plates 100 are fixed to a bottom platform 102 for supporting a fixed vane 104 of the nozzle 106 of the low-pressure turbine. Assembled together, these plates create an annular cavity 108 fed with cooling air via link bushings 110 collecting the air that comes from the base of the fixed vane 104 of the nozzle. Holes 112 formed through the plate 100 serve to inject the cooling air towards a disk 114 for the moving blades 116 of the high-pressure turbine and a disk 118 for the rotary blades 120 of the low pressure turbine. A fourth annular plate 122 extends radially between the three assembled-together plates 100 and a flange 124 on the disk 114 for the moving blades, enabling the assembly to define a high-pressure enclosure 126 and a low-pressure enclosure 128.

The quality of cooling applied to the disks of the high- and low-pressure turbines depends in particular on the feed of cooling air from the injection cavity defined by the annular plate of the cooling device. In particular, it is important to obtain good leaktightness for said cavity and to avoid head losses in its feed. Head losses are generally the result of poor quality air flow at the outlet from the link bushings. In the cooling device shown in FIG. 7, the air flow coming from the link bushings 110 is subjected to a large change of direction (as represented by arrow 130) which gives rise to head losses that are harmful for good operation of the device.

The head losses due to changes in the flow direction of the air feeding such cooling devices are also considerably more marked when the nozzle of the low-pressure turbine is a so-called "swan-necked" nozzle. A swan-neck nozzle is characterized by bottom and top platforms for supporting the fixed vanes that are elongated so as to increase the aerodynamic performance of the low-pressure turbine. Under such circumstances, the plates of the turbine disk cooling device are bent so as to adapt to the elongate shape of the bottom platform of the nozzle so that the cooling air coming from the bases of the fixed vanes is subjected to large changes of direction. As a result, head losses are high at the bends in the plates.

OBJECT AND BRIEF SUMMARY OF THE INVENTION

The present invention thus seeks to mitigate such drawbacks by proposing a turbine disk cooling device that is adapted in particular to the shape of a swan-neck nozzle, the device enabling head losses to be reduced while maintaining good leaktightness.

To this end, the invention provides a cooling device for cooling disks of high-pressure and low-pressure turbines of a turbomachine, said device being fed with cooling air from at least one air orifice formed through a bottom annular platform for supporting at least one fixed vane of said low-pressure turbine and being disposed between an upstream flange and a downstream flange of said bottom platform, the device comprising: an upstream annular plate extending radially from the upstream flange of said bottom platform; a downstream annular plate extending radially from the downstream flange of the bottom platform, said upstream and downstream plates longitudinally defining at least one annular cavity for cooling air; a sealing device extending longitudinally between said upstream and downstream plates so as to close the cooling air cavity in leaktight manner; holding means for holding said upstream and downstream plates against the upstream and downstream flanges of said bottom platform; and a plurality of holes for injecting cooling air towards the turbine disks.

Thus, the way these plates are assembled together enables head losses to be limited by creating a cooling air cavity that is properly leaktight. The upstream and downstream plates of the cooling device do not form bends so the cooling air cavity can be fed directly without head losses from the air orifice formed through a bottom platform. In addition, the cooling device comprises only two plates, thereby providing a saving in weight compared with prior art devices.

Preferably, the upstream plate includes a link portion linked to the bottom platform and formed by a substantially radial annular wall, and an injection portion formed by a substantially radial first annular wall offset radially and longitudinally downstream relative to said link portion, a second substantially radial annular wall offset longitudinally downstream relative to said first radial wall, and a first substantially-longitudinal annular wall extending between the radial wall of said link portion and the second radial wall of said injection portion so as to subdivide the cooling air cavity longitudinally into a bottom zone and a top zone.

The injection portion of the upstream plate further comprises a second substantially-longitudinal annular wall extending between the first and second radial walls and disposed between the first longitudinal wall and the sealing device so as to subdivide the bottom zone into a mounting zone and an injection zone. A plurality of substantially radial partitions extending between the first and second longitudinal walls and disposed perpendicularly to the first and second radial walls enable the mounting zone to be subdivided into a plurality of annular cavities.

The first longitudinal wall of said injection portion of the upstream plate includes communication openings providing communication between the bottom and top zones so as to feed cooling air to at least one annular cavity, said communication openings having axes extending radially in register with said air orifices formed through the bottom platform. The or each annular cavity fed with cooling air includes at least one passage through the second longitudinal wall enabling the injection zone to be fed with cooling air. The injection zone presents a plurality of holes formed through the first and second radial walls of the injection portion of the upstream plate in order to inject cooling air towards the turbine disks.

Advantageously, link tubes are disposed in each communication opening in order to feed cooling air to the annular cavity(ies). Under such circumstances, radial retention devices can be provided for each of the link tubes, and the second radial wall of the injection portion of the upstream plate may include a plurality of annular windows for mounting link tubes.

In addition, and advantageously, the downstream plate includes a link portion linking it with the bottom platform and formed by a substantially radial annular wall, and a holding portion for holding the upstream plate formed by a substantially radial annular wall offset radially and longitudinally upstream relative to the link portion and placed against the second radial wall of the injection portion of the upstream plate, and a longitudinal wall extending between the radial walls of the link portion and of the holding portion.

In addition, the cooling device may further comprise an additional annular plate extending radially between the sealing device and a flange of the disk of moving blades of the high-pressure turbine so as to define a high-pressure enclosure and a low-pressure enclosure on either side of said cooling device. Stiffener elements are preferably placed between the ends of the additional annular plates so as to improve the dynamic behavior of the cooling device.

BRIEF DESCRIPTION OF THE DRAWINGS

Other characteristics and advantages of the present invention appear from the following description given with reference to the accompanying drawings which show an embodiment that has no limiting character. In the figures.

DETAILED DESCRIPTION OF AN EMBODIMENT

Figure 1:
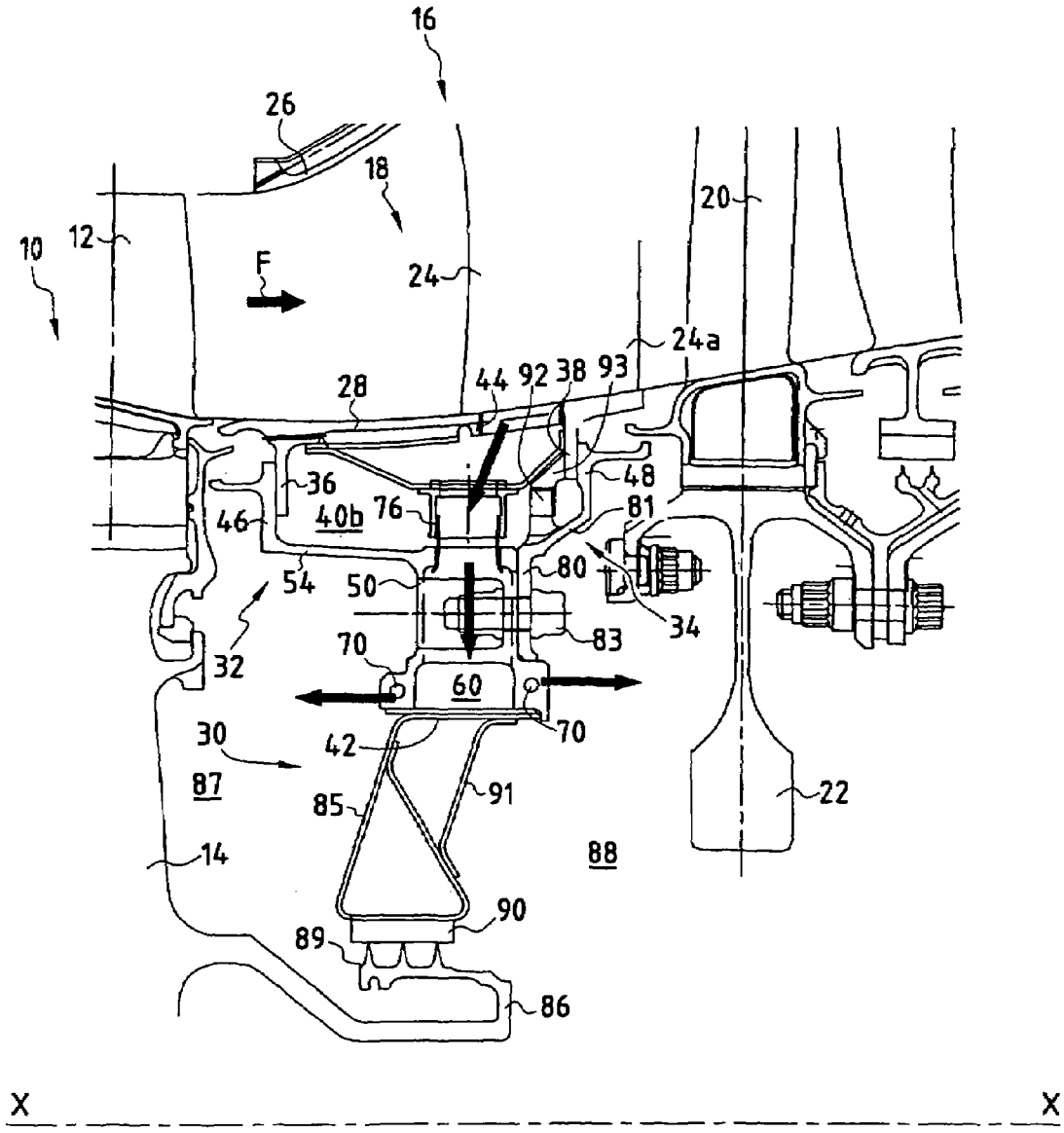
FIG. 1 is a fragmentary longitudinal section view of a cooling device of the invention.
Figure 2:
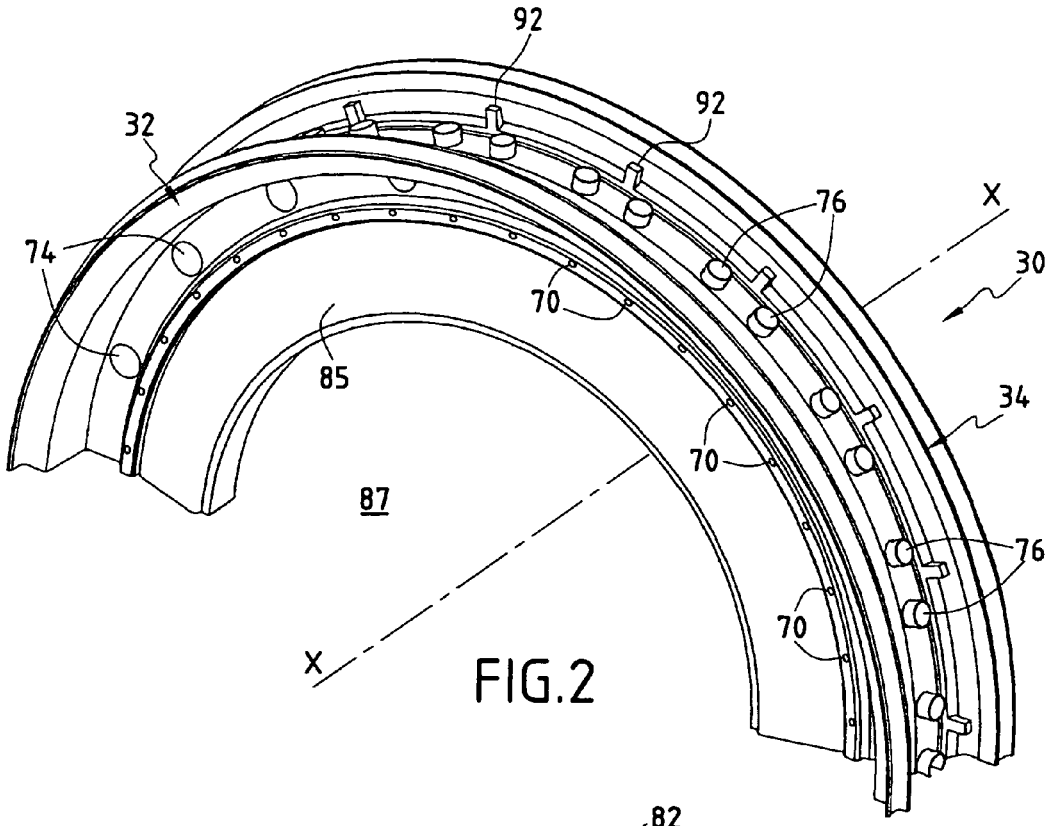
FIGS. 2 and 3 are two different perspective views of the FIG. 1 cooling device.

FIG. 1 is a longitudinal section view of a cooling device of the invention in its environment.

In this figure, there can be seen in particular a high-pressure turbine 10 of longitudinal axis X—X provided with a plurality of moving blades 12 (only one shown in FIG. 1). The moving blades 12 are all mounted on an annular disk 14 that rotates about the longitudinal axis X—X. A low-pressure turbine 16, likewise of longitudinal axis X—X, is disposed downstream from the high-pressure turbine 10 in the gas flow coming from the high-pressure turbine. The low-pressure turbine 16 comprises a plurality of turbine stages (only one stage is shown in full in FIG. 1) each comprising a nozzle 18 and a plurality of rotary blades 20 placed behind each nozzle. All of the rotary blades 20 are mounted on an annular disk 22 that rotates about the longitudinal axis X—X. Finally, each nozzle 18 is itself made up of a plurality of fixed vanes 24 supported by a top annular platform 26 and by a bottom annular platform 28.

In FIG. 1, the nozzle 18 of the first stage of the low-pressure turbine has a swan-neck configuration, i.e. the top and bottom platforms 26 and 28 thereof are elongated in order to increase the distance between the leading edges of the fixed vanes 24 of the nozzle and the trailing edges of the moving blades 12 of the high-pressure turbine 10. This configuration enables the performance of the low-pressure turbine to be improved. Nevertheless, the present invention can also be applied to low-pressure turbine nozzles in which the vane support platforms are not elongated.

In the invention, the cooling device 30 for cooling the disk 14 of the moving blades 12 of the high-pressure turbine and the disk 22 of the rotary blades 20 of the low pressure turbine is constituted in particularl by assembling together an upstream annular plate 32 and a downstream annular plate 34. Each of the upstream and downstream plates 32 and 34 is in the form of an annulus whose axis of symmetry coincides with the longitudinal axis X—X of the high- and low-pressure turbines.

As shown in FIG. 1, the upstream plate 32 extends radially from a flange 36 disposed at an upstream end of the bottom platform 28, while the downstream plate 34 extends radially from a flange 38 disposed at an upstream end of the same platform. These upstream and downstream plates thus define an annular enclosure 40 which is closed in leaktight manner by a sealing device, e.g. an annular piece of sheet metal 42 fixed between the free ends of the upstream and downstream plates. The annular enclosure 40 is fed with air coming from a cooling circuit which is fitted to each fixed vane 24 of the nozzle 18. Typically, air which is taken for example from the high-pressure compressor of the turbomachine, is introduced into each fixed vane 24 of the nozzle via its tip, then flows inside the fixed vane along a path defined by a cooling cavity (not shown) possibly fitted with a liner, prior to being exhausted via the base 24*a* of the vane through orifices 44 passing through the bottom platform 28. These air-exhaust orifices 44 are provided at the base 24*a* of each vane between the upstream flange 36 and the downstream flange 38 of the bottom platform.

The shape of the upstream and downstream plates is described in greater detail below. In this description, the top end of a plate is defined in contrast to its bottom end as being the end of the plate that is furthest from the longitudinal axis X—X. Similarly, the concept of upstream and downstream are to be understood relative to the flow direction F of gas coming from the high-pressure turbine.

At their top ends, each of the upstream and downstream plates has a link portion for connection to the upstream or downstream flange 36 or 38 of the bottom platform 28 of the nozzle 18. Since the flanges project radially relative to the bottom platform, the link portions are constituted by annular walls 46, 48 extending radially so as to press against the flanges during mounting of the bottom platform 28 on the cooling device. The means for holding the link portions of the upstream and downstream plates against the flanges are described below.

At a bottom end opposite from its link portion, the upstream plate 32 also comprises an injection portion formed in particular by a first annular wall 50 extending radially and offset longitudinally downstream from the wall 46 of its link portion, and a second annular wall 52 extending radially and offset relative to the first annular wall 50 both radially towards the longitudinal axis X—X and longitudinally downstream. A first annular longitudinal wall 54 connects a bottom end of the wall 46 of the link portion to a top end of the second wall 52. This first longitudinal wall thus subdivides the annular enclosure 40 into a bottom zone 40*a* and a top zone 40*b*.

Figure 4:
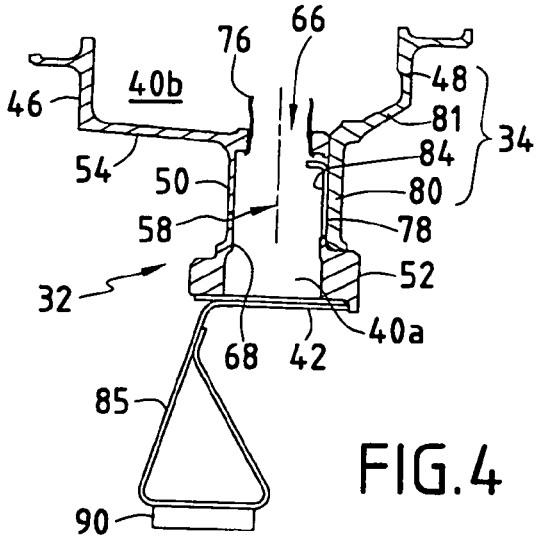
FIGS. 4 and 5 are respective section views on IV—IV and V—V of FIG. 3.
Figure 5:
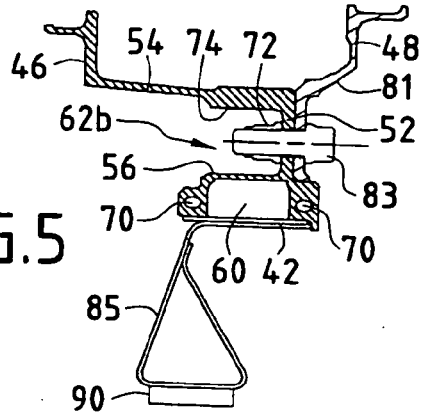
Figure 6:
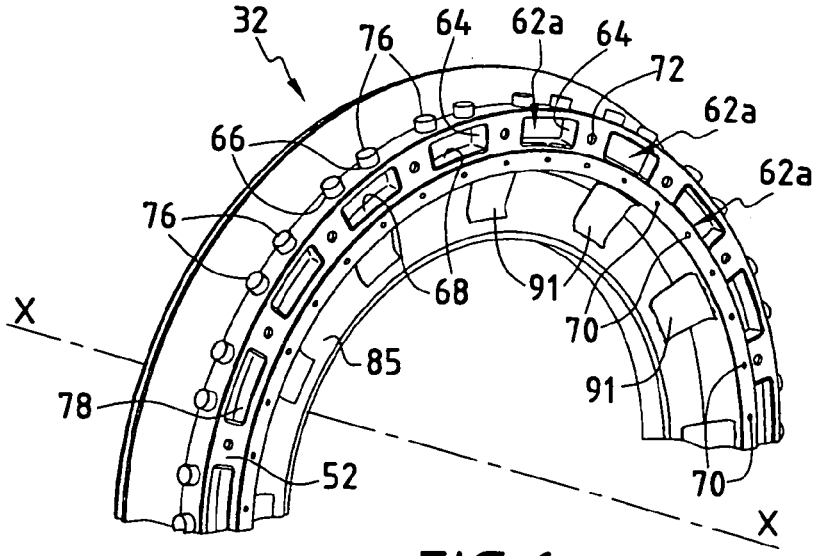
FIG. 6 is a fragmentary perspective view of the FIG. 1 cooling device showing how it is mounted.
Figure 7:
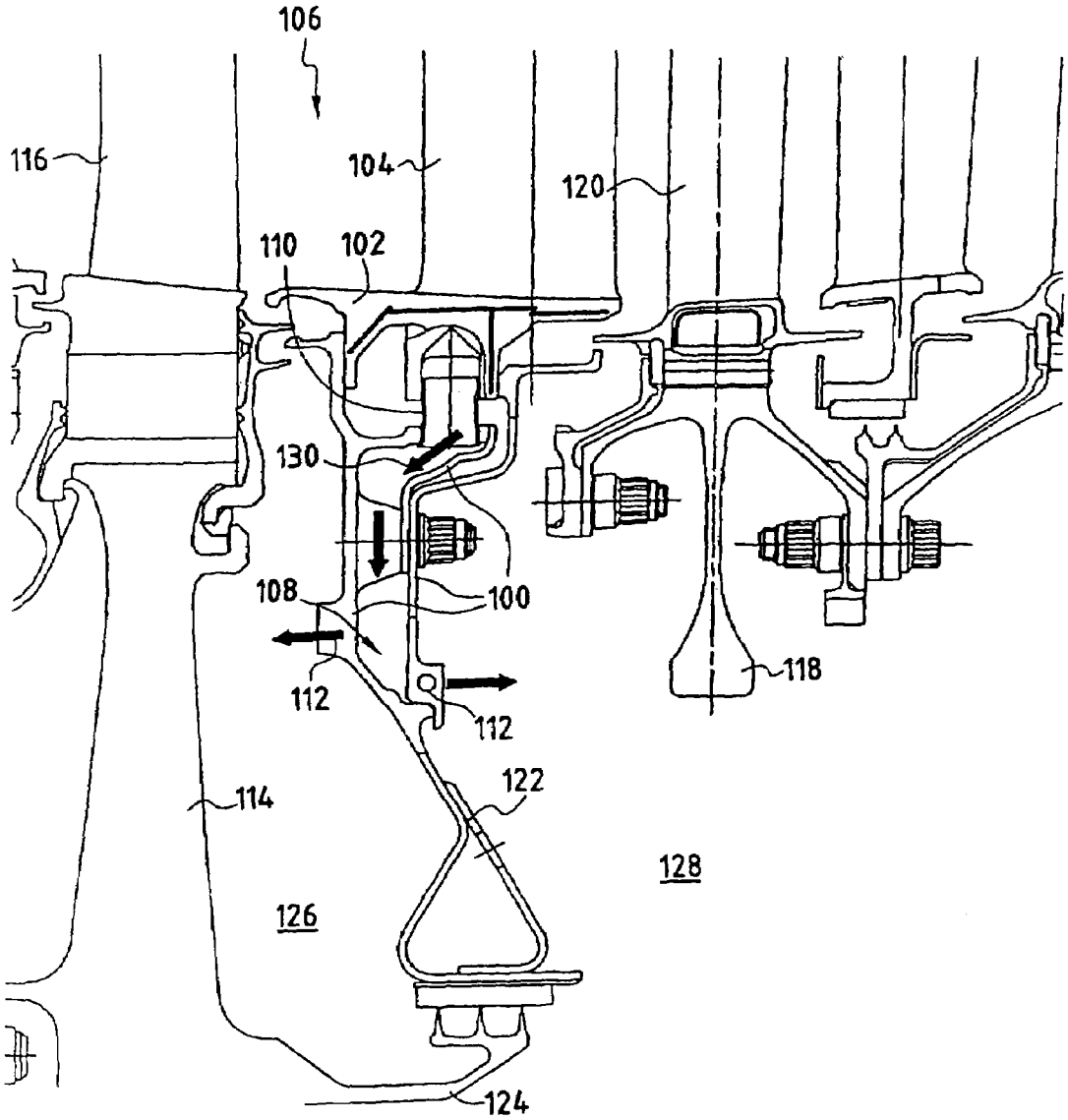
FIG.7 PRIOR ART
FIG. 7 is a fragmentary longitudinal section view of a prior art cooling device.

As shown in FIGS. 4 and 5, the injection portion of the upstream plate further comprises a second annular longitudinal wall 56 which extends between the first and second radial walls 50, 52. This second longitudinal wall 56 is also disposed between the first longitudinal wall 54 and the annular piece of sheet metal 42 forming the sealing device 42 so as to subdivide the bottom zone 40*a* into a mounting zone 58 and an injection zone 60. In addition, as shown in FIG. 6, the mounting zone 58 is itself subdivided into a plurality of annular cavities 62 by radial partitions 64. These radial partitions are disposed perpendicularly to the first and second radial walls 50 and 52 of the injection portion of the upstream plate and they extend between the first and second longitudinal walls 54 and 56. They are regularly spaced apart around the longitudinal axis X—X of the turbines. Thus, the mounting zone 58 is segmented into a plurality of annular cavities 62, whereas the injection zone 60 is continuous all around the longitudinal axis X—X.

The first longitudinal wall 54 of the injection portion of the upstream plate has a plurality of openings 66 for putting the top zone 40*b* into communication with the bottom zone 40*a* so as to feed the bottom zone with cooling air. More precisely, these openings 66 open out into the top zone 40*b* and lead into some of the annular cavities 62*a* formed in the mounting zone 58. In the embodiment shown in FIG. 6, the openings are disposed in such a manner that the top zone feeds cooling air only to every other annular cavity 62, with two openings being provided leading into the same annular cavity. Naturally, other configurations could be devised concerning the number of annular cavities communicating with the top zone and the number of communication openings per annular cavity fed in this way.

In each annular cavity 62*a* which is fed in this way with cooling air via the openings 66, the second annular longitudinal wall 56 presents at least one passage 68 enabling cooling air to pass from the annular cavity 62*a* to the injection zone 60. In addition, the openings 66 are arranged in the first longitudinal wall 54 in such a manner as to be in axial alignment with the air orifices 44 formed in the bottom platform 28 (FIG. 1). In this way, head losses in the feed to each annular cavity 62*a* are limited.

The injection zone 60 opens out towards the disk 14 of moving blades 12 of the high-pressure turbine, and towards the disk 22 of rotary blades 20 of the low-pressure turbine via a plurality of holes 70 formed through the first and second radial walls 50, 52 of the injection portion of the upstream plate. For example, these holes 70 may be-inclined (as shown in the figures) or they may be straight. Any other system enabling a desired flow rate for cooling the high- and low-pressure turbine disks to be calibrated could also be used. Thus, the air exhausted through the orifices 44 of the bottom platform 28 feeds the top zone 40*b* and then some of the annular cavities 62*a* via the openings 66. The air then diffuses into the injection zone 60 via the passages 68 prior to being exhausted through the holes 70 to cool the disk 14 of moving blades of the high-pressure turbine and the disk 22 of rotary blades of the low-pressure turbine.

In the example shown in the figures, every other annular cavity 62 is fed with cooling air via the openings (the cavities 62*a*). The annular cavities 62*b* that are not fed with air serve to enable the downstream plate to be fixed to the upstream plate. For this purpose, the second radial wall 52 of the injection portion of the upstream plate presents holes 72 in at least some of its non-fed cavities 62*b*, which holes 72 serve to pass screw/nut type bolt fasteners. In addition, for each cavity 62*b* that is not fed with cooling air and that presents one of these holes, the first radial wall 50 of the injection portion presents openings 74, e.g. circular openings placed in register with the holes. These openings facilitate access to the bolt fasteners while the upstream and downstream plates are being assembled together and enables the nuts of these fasteners to be "sunk" so as to avoid generating turbulence.

Advantageously, link tubes 76 may be disposed in each of the openings 66 to guide the cooling air towards the annular cavities 62*a*. In order to make it easier to mount the link tubes 76, it is also preferable to arrange annular windows 78 in the second radial wall 52 of the injection portion of the upstream plate in the annular cavities 62*a* that are fed with air.

At a bottom end opposite from its link portion, the downstream plate 34 includes a portion for holding the upstream plate, which portion is formed by an annular wall 80 extending radially and offset relative to the radial wall 48 of its link portion, both radially towards the longitudinal axis X—X and longitudinally upstream. This radial annular wall 80 is disposed so as to press against the second radial wall 52 of the injection portion of the upstream plate. It is also centered with clamping against the upstream plate so as to ensure that the cooling device is leaktight. An annular longitudinal wall 81 connects a bottom end of the radial wall 48 of the link portion to a top end of the radial wall 80 of the holding portion.

The radial wall 80 of the holding portion presents a plurality of holes 82 for receiving bolt fasteners. These holes 82 are disposed all around the longitudinal axis X—X so as to coincide with the holes 72 in the upstream plate when the upstream and downstream plates are assembled one against the other. The upstream and downstream plates 32 and 34 can thus be held pressed one against the other after the bottom platform 28 has been assembled by means of the bolt fasteners 83. This particular disposition of the holding means enables an assembly to be obtained in which the bottom platform 28 is lightly pre-stressed against the upstream and downstream plates 32 and 34 so as to improve the dynamic behavior of the cooling device, while limiting relative longitudinal displacements and ensuring good leakproofing of the bottom and the top zones.

In addition, when the link tubes 76 are disposed in each of the openings 66 of the upstream plate, the radial wall 80 of the holding portion of the downstream plate includes devices for retaining these tubes radially. Such retention devices may be constituted, for example, by brackets 84 mounted against the radial wall 80 and of dimensions adapted to be received in the annular windows 78 of the second annular wall 52 of the injection portion of the upstream plate.

Figure 3:
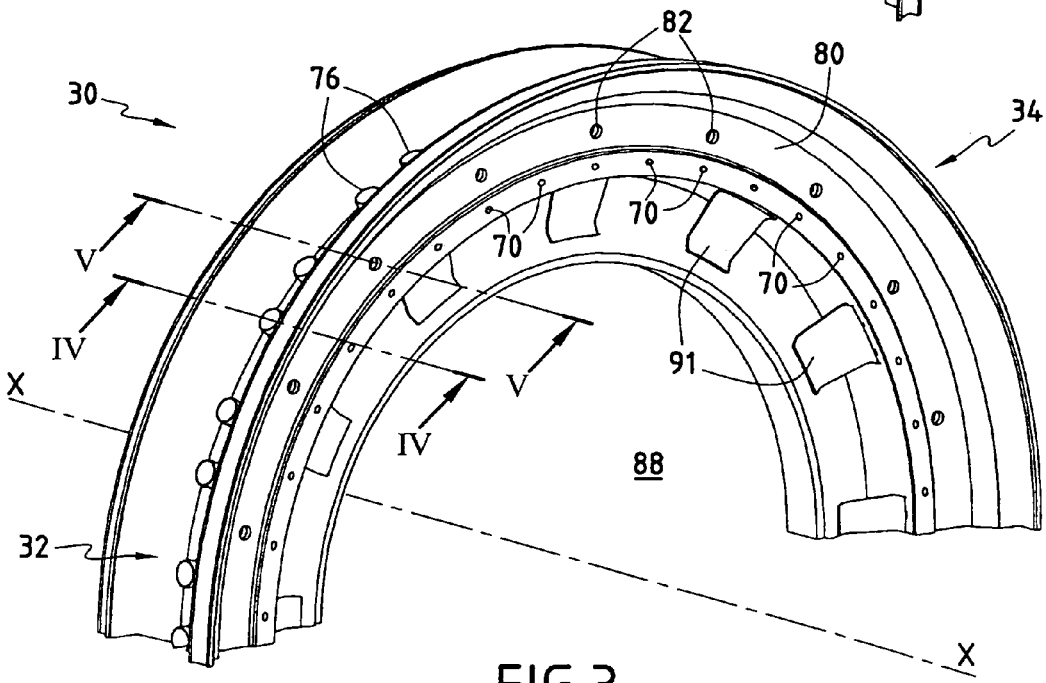

According to an advantageous characteristic of the invention, the cooling device 30 as made in this way includes an additional annular plate 85 which extends radially between the sealing device 42 and a flange 86 of the disk 14 of moving blades of the high-pressure turbine with which it is in contact. This additional plate 85 thus serves to define a high-pressure enclosure 87 and a low-pressure enclosure 88 on either side of the cooling device 30. In order to ensure good leakproofing between the high-pressure and low-pressure enclosures as defined in this way, contact between the flange 86 of the disk 14 and the bottom end of the additional plate 85 takes place via sealing means. These means can be implemented in the form of a labyrinth seal 89 formed on the flange 86 and an abradable coating 90 disposed on the bottom end of the additional plate 85. In FIGS. 1, 4, and 5, the additional annular plate 85 is substantially triangular in right section. Under such circumstances, in order to improve the dynamic behavior of the cooling device, stiffener elements 91 can be disposed between the top and bottom ends of the additional plate. As shown in FIGS. 3 and 6, such stiffener elements may, for example, be in the form of pieces of sheet metal fixed to the top and bottom ends of the additional plate 85.

According to another advantageous characteristic of the invention, the cooling device 30 may also include an anti-rotation device for preventing rotation of the assembled-together upstream and downstream plates 32 and 34. Such an antirotation device may be constituted by a plurality of radial pegs 92 disposed on the downstream plate 34 extending the radial annular wall 80 of its holding portion. As shown in FIG. 1, these pegs 92 thus come into abutment in notches 93 in the bottom platform 28 of the nozzle so as to prevent any unwanted turning of the cooling device. Alternatively, the pegs may be formed on the-upstream plate 32, e.g. level with the first longitudinal wall 54 of its injection portion. In this configuration (not shown in the figures) the pegs likewise come into abutment within notches in the bottom platform.

In a variant of the invention (not shown), the upstream and downstream plates of the cooling device can be made as a single piece so as to constitute one plate. Under such circumstances, it is appropriate, for example, to use link tubes with flanges enabling them to be held in place radially. In addition, a flange should also be provided at the radial wall of the link portion of the upstream plate so as to enable special tooling to be used to eliminate prestress while the bottom platform is being mounted on the single plate. Such a single-plate variant makes it possible to omit the bolt fasteners, thereby reducing the overall weight and the time required for assembly purposes.

The cooling device as defined above presents numerous advantages. In particular, it serves to reduce head losses, thereby making it possible to decrease the specific consumption of the turbomachine. However this reduction in head losses does not lead to degraded aerodynamic behavior of the device. In addition, the device is entirely suitable for a low-pressure turbine nozzle of swan-necked configuration. It should also be observed that since the number of plates is smaller than in prior art devices, the weight of the cooling device of the invention is reduced and it is easier to assemble.

What is claimed is:

1. A cooling device for cooling disks of high-pressure and low-pressure turbines of a turbomachine, said device being fed with cooling air from air orifices formed through a bottom annular platform for supporting at least one fixed vane of said low-pressure turbine and being disposed between an upstream flange and a downstream flange of said bottom platform, the device comprising:

an upstream annular plate extending radially from the upstream flange of said bottom platform;

a downstream annular plate extending radially from the downstream flange of the bottom platform, said upstream and downstream plates longitudinally defining at least one annular cavity for cooling air formed by a top zone fed with cooling air by said air orifices and by a bottom zone in communication with said top zone via a plurality of openings, said bottom zone being in radial alignment with said air orifices and said openings;

a sealing device extending longitudinally between said upstream and downstream plates so as to close the cooling air cavity in a leaktight manner;

holding means for holding said upstream and downstream plates against the upstream and downstream flanges of said bottom platform; and a plurality of holes leading into the bottom zone of the annular cavity and opening out towards the turbine disks for injecting cooling air.

2. A device according to claim 1, wherein the upstream plate includes a link portion linked to the bottom platform and formed by a substantially radial annular wall, and an injection portion formed by a substantially radial first annular wall offset radially and longitudinally downstream relative to said link portion, a second substantially radial annular wall offset longitudinally downstream relative to said first radial wall, and a first substantially longitudinal annular wall extending between the radial wall of said link portion and the second radial wall of said injection portion so as to subdivide the cooling air cavity longitudinally into the bottom zone and top zone.

3. A device according to claim 2, wherein the injection portion of the upstream plate further comprises a second substantially-longitudinal annular wall extending between the first and second radial walls and disposed between the first longitudinal wall and the sealing device so as to subdivide the bottom zone into a mounting zone and an injection zone.

4. A device according to claim 3, wherein the injection portion of the upstream plate further comprises a plurality of substantially radial partitions extending between the first and second longitudinal walls and disposed perpendicularly to the first and second radial walls so as to subdivide the mounting zone into a plurality of annular cavities.

5. A device according to claim 4, wherein said openings providing communication between the bottom and top zones are formed in the first longitudinal wall of said injection portion of the upstream plate so as to feed cooling air to at least one annular cavity.

6. A device according to claim 5, wherein said at least one annular cavity fed with cooling air includes at least one passage in the second longitudinal wall for feeding the injection zone with cooling air.

7. A device according to claim 6, wherein the injection zone presents a plurality of holes formed through the first and second radial walls of the injection portion of the upstream plate in order to inject cooling air towards the turbine disks.

8. A device according to claim 5, further comprising link tubes disposed in each communication opening in order to guide the cooling air towards said at least one annular cavity.

9. A device according to claim 8, further including radial retention devices for retaining each of said link tubes.

10. A device according to claim 8, wherein the second radial wall of the injection portion of the upstream plate includes a plurality of annular windows for mounting said link tubes.

11. A device according to claim 2, wherein the downstream plate includes a link portion connecting with the bottom platform formed by a substantially radial annular wall, and a holding portion for holding the upstream plate formed by a substantially radial annular wall offset radially and longitudinally upstream relative to said link portion and disposed against the second radial wall of the injection portion of the upstream plate, and a substantially longitudinal annular wall extending between the radial wall of said link portion and the radial wall of said holding portion.

12. A device according to claim 1, further comprising an additional annular plate extending radially between the sealing device and a flange of the disk of moving blades of the high-pressure turbine so as to define a high-pressure enclosure and a low-pressure enclosure on either side of said cooling device.

13. A device according to claim 12, further comprising stiffener elements disposed between the ends of said additional annular plate in order to improve the dynamic behavior of the cooling device.

14. A device according to claim 1, further comprising an antirotation device for preventing said upstream and downstream plate from rotating.

15. A device according to claim 1, wherein said upstream and downstream plates are parts separate and distinct from each other.

16. A cooling device configured to cool a high-pressure turbine disk and a low-pressure turbine disk of a turbomachine, the device comprising:

upstream and downstream annular plates forming an air cavity with a platform configured to support at least one fixed vane of the turbomachine, the air cavity comprising a top portion and a bottom portion, the top portion being configured to be supplied with air from orifices in the platform and being in communication with the bottom portion via a plurality of openings, and the bottom portion, the air orifices, and the plurality of openings being aligned radially with respect to each other;

a sealing element extending between the upstream and downstream plates so as to seal the air cavity; and a plurality of holes disposed on an external wall of the bottom portion of the air cavity, the plurality of holes being configured to eject cooling air from the air cavity to cool the high-pressure and low-pressure turbine disks.

17. A device according to claim 16, further comprising an additional annular plate extending radially between the sealing element and a flange of a disk of moving blades of the high-pressure turbine so as to define a high-pressure enclosure and a low-pressure enclosure on either side of the cooling device.

18. A device according to claim 17, further comprising stiffener elements disposed between the ends of said additional annular plate in order to improve a dynamic characteristic of the cooling device.

19. A device according to claim 16, wherein the bottom portion of the air cavity further comprises a wall that devides the bottom portion into a mounting portion and an ejection portion, the mounting portion is segmented into a plurality of annular cavities, the ejection portion is continuous around a longitudinal axis of the turbomachine, and the openings are disposed such that cooling air is fed from the top portion to every other annular cavity of the plurality.

20. A device according to claim 19, wherein the openings are disposed such that cooling air is fed from the top portion to every other annular cavity of the plurality with two openings being provided leading into the same annular cavity.

* * * * *